US006446861B1

(12) United States Patent
Smith

(10) Patent No.: US 6,446,861 B1
(45) Date of Patent: Sep. 10, 2002

(54) ENVELOPE FOR CONTROLLING AND IDENTIFYING ACCESS TO THE CONTENTS AND A METHOD OF USE

(75) Inventor: Robert F. Smith, 2713 Howard Grove Rd., Davidsonville, MD (US) 21035

(73) Assignee: Robert F. Smith, Davidson, MD (US)

( * ) Notice: Subject to any disclaimer, the term of this patent is extended or adjusted under 35 U.S.C. 154(b) by 56 days.

(21) Appl. No.: 09/680,182

(22) Filed: Oct. 5, 2000

(51) Int. Cl.[7] ..... B65D 27/06

(52) U.S. Cl. ..... 229/306; 229/80; 229/301; 283/116; 383/5; 383/84

(58) Field of Search ..... 283/116, 101; 383/78, 84, 5; 229/80, 83, 301, 305, 306

(56) References Cited

U.S. PATENT DOCUMENTS

| | | | | | |
|---|---|---|---|---|---|
| 192,522 | A | * | 6/1877 | Marshall | 229/301 |
| 532,958 | A | * | 1/1895 | Hickok | 229/83 |
| 589,158 | A | * | 8/1897 | Brown | 229/83 |
| 661,690 | A | * | 11/1900 | Forney | 229/301 X |
| 680,480 | A | * | 8/1901 | Ernst | 229/305 |
| 930,837 | A | | 8/1909 | Bushnell, Jr. | |
| 1,091,172 | A | | 3/1914 | Thayer | |
| 1,344,394 | A | * | 6/1920 | Hoffman | 229/301 |
| 3,894,755 | A | | 7/1975 | Cieslak et al. | |
| 4,613,157 | A | | 9/1986 | Drabish | |
| 5,060,848 | A | * | 10/1991 | Ewan | 206/459.1 |
| 5,077,001 | A | * | 12/1991 | Makowka | 383/5 |
| 5,950,916 | A | * | 9/1999 | Santangelo | 229/301 |

FOREIGN PATENT DOCUMENTS

| | | | | |
|---|---|---|---|---|
| CH | 0085876 | * | 11/1920 | 229/301 |
| DE | 004017758 A | * | 12/1991 | 383/5 |
| EP | 0459012 | * | 12/1991 | 383/5 |
| EP | 0459311 | * | 12/1991 | 383/5 |
| FR | 2.158.471 | * | 6/1973 | 383/5 |
| GB | 1536784 | * | 12/1978 | 383/78 |
| GB | 2167381 | * | 5/1986 | 383/5 |

* cited by examiner

*Primary Examiner*—Jes F. Pascua
(74) *Attorney, Agent, or Firm*—Leonard Bloom; Robert M. Gamson

(57) ABSTRACT

An envelope having a base panel, folded side panels and folded end panels forms a pouch. A selected item is received in the pouch. The folded end panels have uncoverable adhesive strips and entry indicators such that the end panels may be attached to the envelope and severed from the envelope in a predetermined sequence. Security tape is disposed over the severed entry indicator and the severed end panel to secure access to the selected item and to permanently affix the entry indicator to the envelope. A method of using the envelope is disclosed.

12 Claims, 6 Drawing Sheets

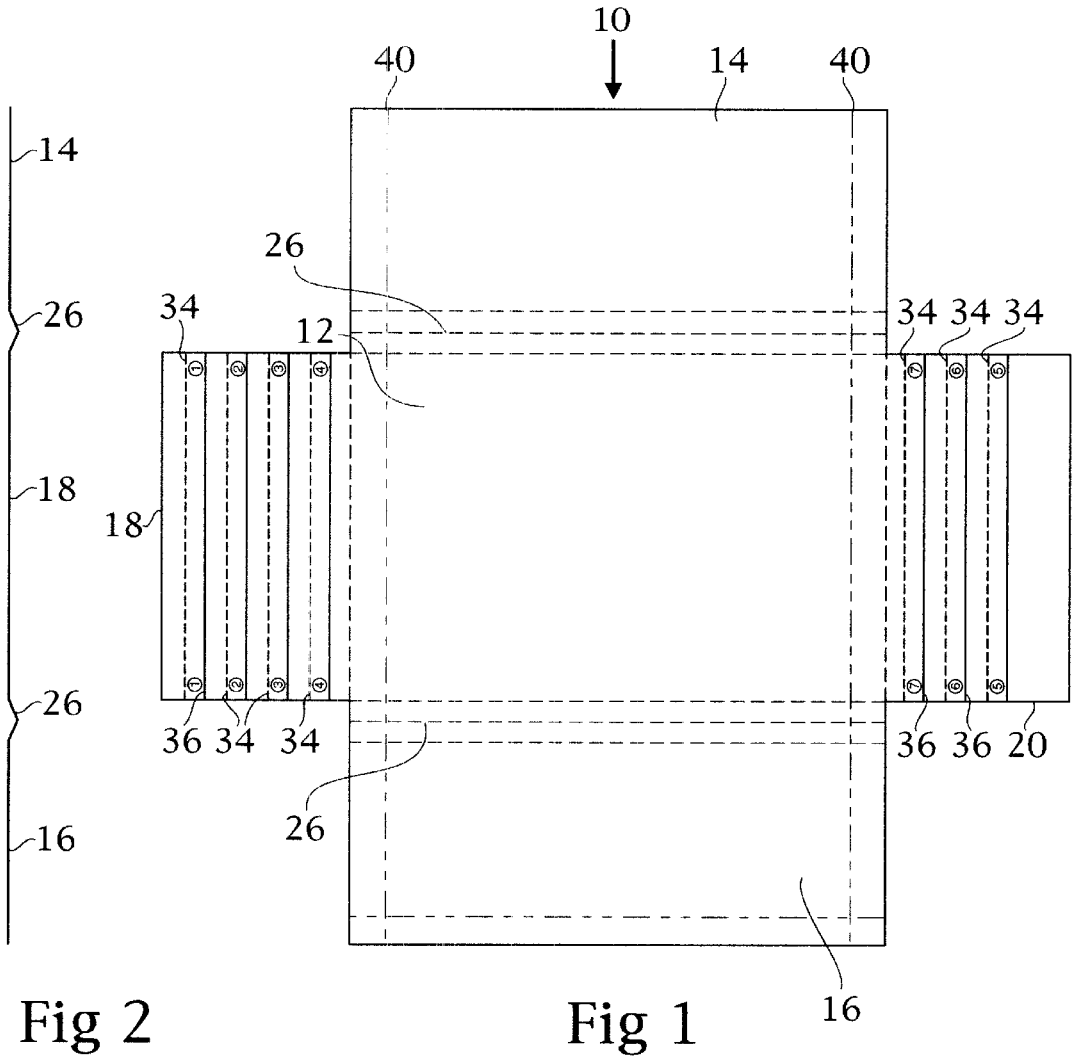
Fig 2
Fig 1
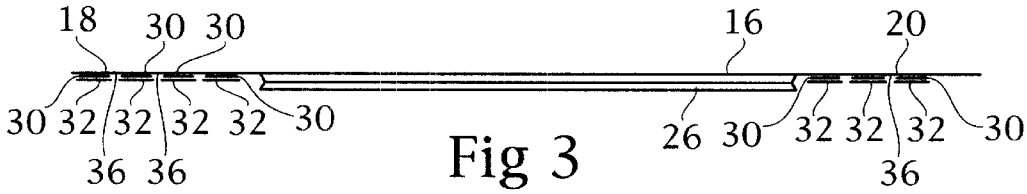
Fig 3

ENVELOPE FOR CONTROLLING AND IDENTIFYING ACCESS TO THE CONTENTS AND A METHOD OF USE

BACKGROUND OF THE INVENTION

1. Field of the Invention

The present invention relates to an envelope for containing an item to which access must be controlled and for identifying those persons who have accessed the contained item.

2. Description of Related Art

There are many situations where selected items must be retained with access to the items limited to authorized persons. These situations arise in diverse fields such as law enforcement, legal offices, courts, postal offices, government, etc. The selected items may be objects or documents related to evidence in criminal situations, suspected counterfeiting. classified or otherwise sensitive documents. In several widely publicized criminal cases, there have recently been allegations of poor police control of evidence which has been a major factor in the verdict.

A simple routing envelope is frequently used in industry and government to forward a document to another office and is capable of being readdressed and reused. However, there is no secure means to limit access to the contents nor is there any record of who has had access to the contents. Certified Mail, Express Mail and courier services can be used to transmit a sealed envelope with a record of the receiving party, but there is no control after the envelope has been delivered.

U.S. Pat. No. 930,837 to Bushnell, Jr. discloses an envelope with gussets for filing or carrying correspondence. A tape is provided to tie the envelope. Thayer, in U.S. Pat. No. 1,091,172 discloses a return envelope including respective flaps having addressing surfaces on each flap. The inner surface of each flap has a gummed surface. In U.S. Pat. No. 3,894,755, Cieslak et al disclose a multiple use greeting card having a plurality of signature locations for a record of who has seen the card. Drabish, in U.S. Pat. No. 4,613,157 discloses a reusable greeting card which has several removable signature sections.

The applicant is unaware of any envelopes which may contain selected items to which access is limited and which controls multiple access to the contained items with an identification of all persons who have had access to the contained items.

BRIEF SUMMARY OF THE INVENTION

It is an object of the present invention to provide an envelope to securely retain a selected item and which can be opened multiple times and resealed, with a recordation of the identity of the person opening the envelope.

It is a further object of the present invention to provide a method of securely transmitting a selected item in an envelope maintaining a record of all persons having access to the selected item.

In accordance with the teachings of the present invention, there is disclosed an envelope having a base panel having two opposing foldable side panels and two opposing foldable end panels.

The end panels are approximately perpendicular to the side panels. The side panels are folded to partially overlap one another and are fixedly attached together thereby forming a pouch between the base panel and the overlapping side panels. The pouch is accessible adjacent to each end panel, wherein a selected item may be received in said pouch. At least one of the end panels has a plurality of spaced-apart uncoverable adhesive strips disposed on an underside of the at least one of the end panels defining a like plurality of spaced-apart entry indicators on an opposite upper side of the at least one of the end panels opposite from each adhesive strip, forming a plurality of spacers therebetween. A permanent securing means is formed on the other end panel distal from the base panel. The end panels are folded toward one another over the overlapping side panels. The other end panel is permanently secured to the overlapping side panels. The at least one of the end panels is adhered to the overlapping side panels by the uncoverable adhesive strip. An entry is made on the entry indicator of a first person having access to the selected item. A security tape is disposed over the entry indicator preventing alteration thereof and securing the at least one of the end panels to the overlapping side panels. In this manner, the next adjacent spacer is sequentially opened by a person to gain access to the selected item, the identity of the person being entered on the next adjacent entry indicator, the selected item being replaced in the pouch, the next adjacent entry indicator being adhered to the overlapping side panels by the uncoverable adhesive strip and the security tape being disposed over the entry indicator and the at least one of the end panels such that a permanent record is maintained of persons having access to the selected item. Unauthorized access is prevented.

In another aspect, there is disclosed a method for securely transmitting a selected item in an envelope maintaining a record of all persons having access to the selected item. An envelope is formed having a base panel, two opposing foldable side panels and two opposing foldable end panels connected to the base panel. At least one of the end panels has a plurality of spaced-apart uncoverable adhesive strips disposed on an underside thereof defining a like plurality of spaced-apart entry indicators on an opposite upper side, thereby forming a plurality of segments and a plurality of spacers therebetween. The other end panel has a permanent securing means thereon distal from the base panel.

The side panels are folded to partially overlap one another. The overlapping side panels are fixedly attached together thereby forming a pouch between the base panel and the overlapping side panels, the pouch being accessible adjacent to each end panel. A selected item is disposed into the pouch between the base panel and the overlapping side panels. The end panels are folded at a respective fold line toward one another over the overlapping side panels. The other end panel is permanently secured to the overlapping side panels. The adhesive strip on one of the segments is uncovered and the one of the segments of the at least one of the end panels is adhered to the overlapping side panels adjacent to the permanently secured other end panel. Identification information is entered on the entry indicator of the adhered segment of the at least one of the end panels. A security tape is placed over at least a portion of the adhered segment to indicate tampering. In a predetermined sequence, a next adjacent spacer is severed to gain access to the selected item in the envelope. The adhering of the next adjacent segment, the entering of the identification information and the placing of the security tape is repeated, thereby assuring controlled access to the selected item and permanent recording of each access to the selected item.

These and other objects of the present invention will become apparent from a reading of the following specification taken in conjunction with the enclosed drawings.

BRIEF DESCRIPTION OF THE DRAWINGS

FIG. 1 is a top plan view of the laid open envelope.

FIG. 2 is a bottom plan view of the laid open envelope.

FIG. 3 is an end view of FIG. 2 with the item made thicker for ease of viewing.

FIG. 5 is a perspective view showing overlapping folding of the side panels over the base panel.

FIG. 6 is a perspective view of the overlapping side panels fixedly attached to one another forming a pouch available from each end with a selected item being inserted.

FIG. 7 is a perspective view of the folding of an end panel over the overlapping side panels forming a security fold.

FIG. 8 is a perspective view of the folded end panel permanently secured to the overlapping side panel.

FIG. 9 is a perspective view of the folding of the opposite end panel over the overlapping sides forming an opposite security fold.

FIG. 10 is a perspective view of the closed envelope with a security tape disposed on one of the entry indicators.

FIG. 13 is a perspective view showing opening of a next adjacent spacer.

FIG. 14 is a perspective view showing unfolding the at least one end panel.

FIG. 15 is a perspective view showing removal of the selected item.

FIG. 16 is a perspective view showing replacement of the selected item into the space between the base panel and the overlapping side panels.

FIG. 17 is a perspective view of the envelope showing two segments sealed with security tape.

DESCRIPTION OF THE PREFERRED EMBODIMENTS

Figure 4:
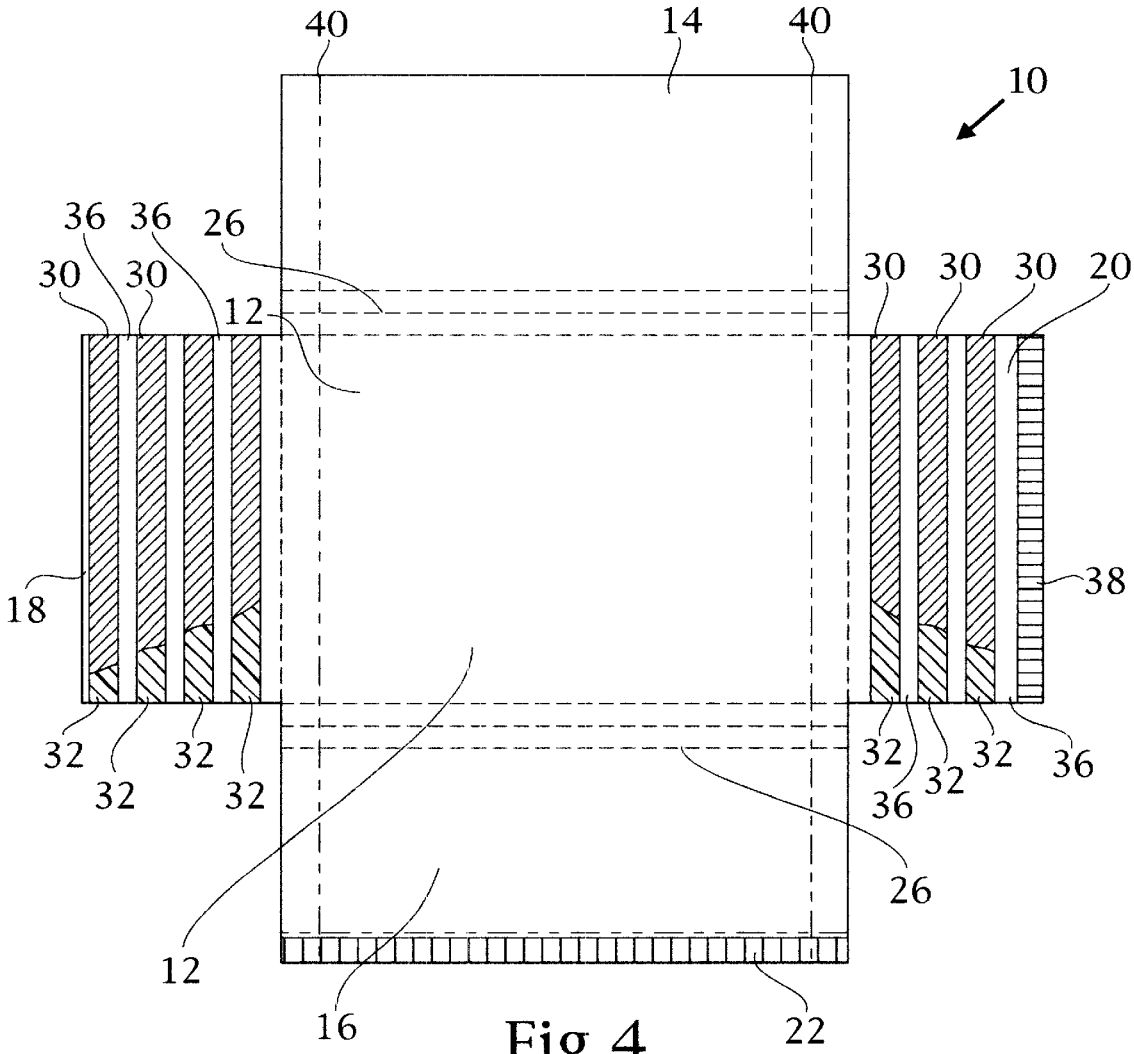
FIG. 4 is a side view of FIG. 2 with the item made thicker for ease of viewing.
Figure 5:
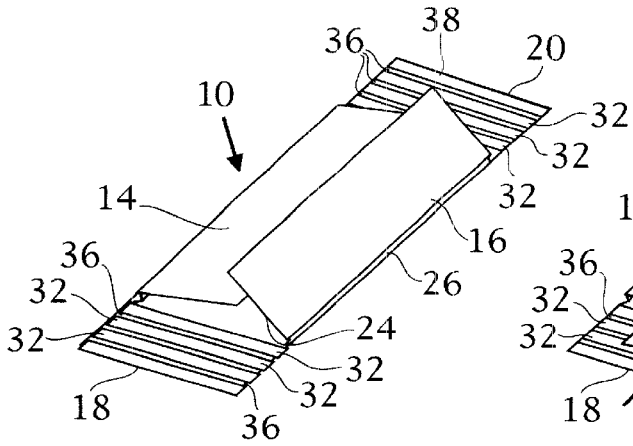
FIGS. 5–10 are a sequence showing folding of the side panels and the end panels.
Figure 6:
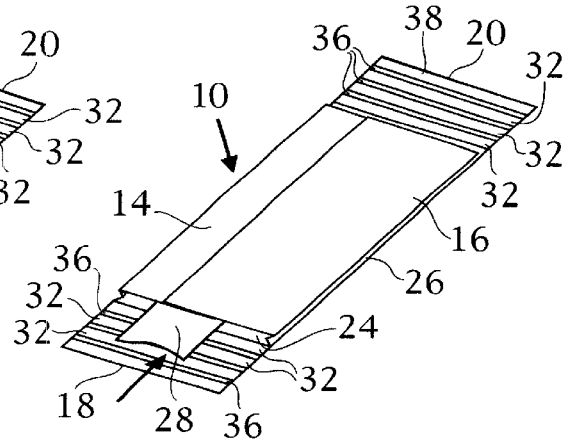
Figure 7:
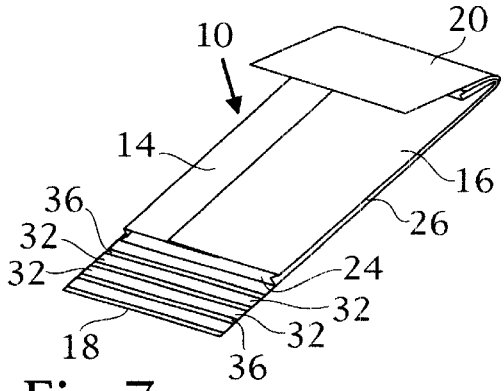
Figure 8:
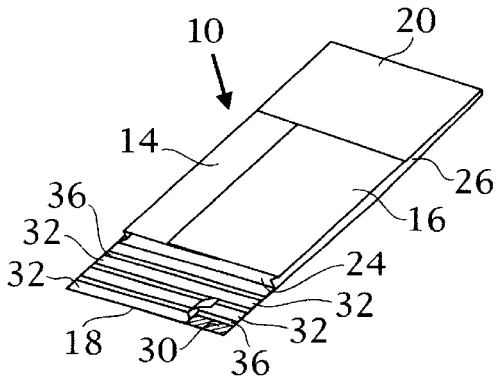
Figure 9:
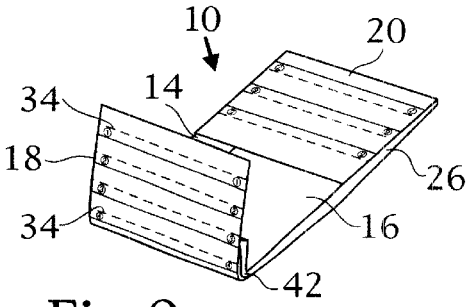
Figure 10:
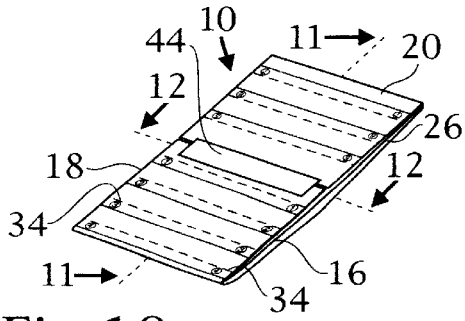
Figure 11:
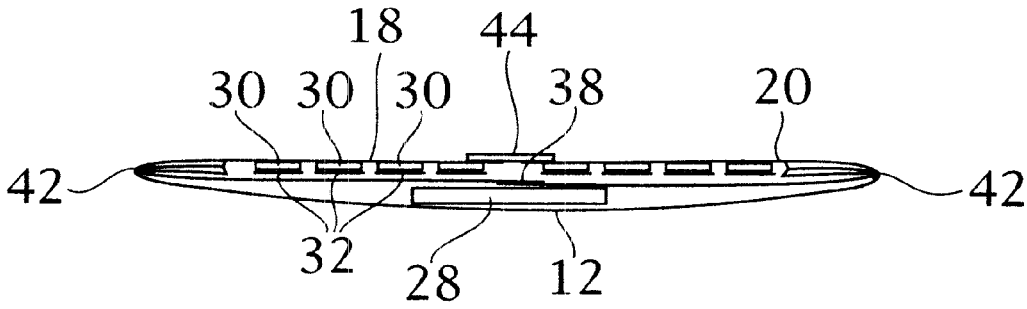
FIG. 11 is a cross-section view taken across the lines 11—11 of FIG. 10. The figure is schematic for ease of illustration.
Figure 12:
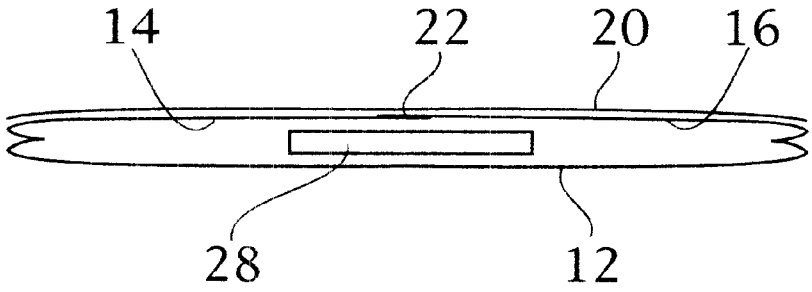
FIG. 12 is a cross-section view taken across the lines 12—12 of FIG. 10. The figure is schematic for ease of illustration.

Referring now to FIGS. 1–4, an envelope 10 has a base panel 12. A first side panel 14, a second side panel 16, a first end panel 18 and a second end panel 20 are connected to the base panel 12 with the end panels 18, 20 being approximately perpendicular to the side panels 14, 16. The side panels 14, 16 are fixedly attached together such as by a permanent adhesive 22 on the surface of one of the panels 14, 16, by staples between the panels 14, 16 or by other means known to persons skilled in the art. A pouch 24 is formed between the base panel 12 and the overlapping side panels 14, 16. The pouch 24 is accessible adjacent to each end panel 18, 20. At least one accordion-like fold 26 (or gusset) is formed on each side panel 14, 16 such that the pouch 24 is expandable to receive selected item(s) of varying size. The selected item(s) 28 may be objects or documents related to evidence in law enforcement applications, sensitive business or government documents, samples of materials or substances which should have limited access. Other uses for the envelope may be found as known to persons skilled in the art.

At least one of the end panels 18, 20, or preferably, both of the end panels 18, 20 has a plurality of spaced-apart uncoverable adhesive strips 30 formed on the underside thereof. Each adhesive strip 30 is covered with a removable release protective strip 32. On the opposite, upper side of each end panel 18, 20, there is defined a plurality of spaced-apart entry indicators 34 which are directly opposed to the adhesive strips 30.

On each entry indicator 34, there is provided space for entry of at least the name or initials of the person gaining access, a location, a time and a date. If required, additional information may be entered. A plurality of spacers 36 are formed between the spaced-apart segments which are the adhesive strips 30/entry indicators 34. Preferably, the segments are marked with an indicator index (numerical or alphabetical).

On the second end panel 20, distal from the base panel 12, there is formed a permanent securing means 38. This may be any means known to persons skilled in the art such as a permanent adhesive, staples or other means which provide indications of opening or attempts at opening the securing of the end panel 20. When the second end panel 20 is folded over the overlapping side panels 14, 16, as described above, the distal portion of the second end panel 20 is folded to approximately the longitudinal mid-point of the overlapping side panels 14, 16 where the distal portion of the first end panel 18 approximately abuts the distal portion of the second end panel 20. The second end panel 20 is secured to the overlapping side panels 14, 16 for reasons as will be described.

When the end panels 18, 20 are folded toward one another, each panel is folded at a fold line 40. The fold includes a segment of each of the overlapping side panels 14, 16 thereby forming a security fold 42 under each folded end panel 18, 20. The security folds 42 prevent unauthorized and undetected external access to the selected item 28 within the pouch 24 since it is not possible to reach between the adhered portion of the end panel 18, 20 and fold to access the pouch 28. The security fold 42 requires an approximately 180° bend to have external entry. Entry is possible only by unfolding the end panel 18, 20.

The envelope 10 is formed as described above by folding the side panels 12, 14 to overlap and fixedly attaching the side panels together forming the pouch 24 between the base panel 12 and the overlapping side panels 14, 16. The selected item 28 is disposed in the pouch 28 and the end panels 18, 20 are folded toward one another about a respective fold line 40. The distal portion of the second end panel 20 is permanently secured to the overlapping side pouch 14, 16. Alternately, the envelope 10 is provided to the initial user as a preformed item with the second end panel 20 folded and secured. The initial user places the selected item 28 into the pouch 24 and removes the removable release protective strip 32 from the uncoverable adhesive strip 30 on the first end panel 20 distal from the base panel 12 (and distal from the fold line 40). The uncovered adhesive strip (segment No. 1)

is adhered to the overlapping side panels 14, 16 adjacent to the secured second end panel 20 and the envelope 10 containing the selected item 28 is completely sealed on all sides. The initial user enters the required information on the entry indicator 34. A security tape 44 is placed over at least a portion of the adhered segment of entry indicator 34 adhered with the opposing adhesive strip 30. It is preferred that the security tape cover at least a portion of the entry on the entry indicator 34 and at least a portion of the edge of the entry indicator so that there is a clear indication of alteration or tampering. Preferably, the entire entry indicator 34 and the seam between the adjacent entry indicator 34 is covered by the security tape 44. The security tape 44, preferably, also overlaps the outer edges of the entry indicator and attaches to the base panel 12. The security tape 44 is an adhesive-backed tape which has a plurality of spaced-apart micro-slits formed therein such that complete removal of the tape is virtually impossible. The security tape 44 tears into multiple sections if removal is attempted. Also, the adhesive is very strong such that if removal is attempted, a portion of the surface to which the security tape 44 is adhered is retained on the security tape 44 showing discontinuity in the entry on the entry indicator 34. It has been found that a product distributed by Lynn Peavey Co. under the name "ZIPR-WELD" has been satisfactory.

Figure 13:
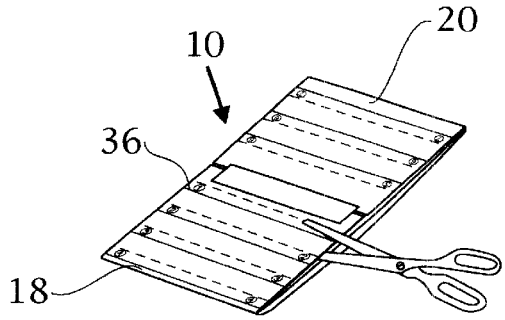
FIGS. 13–17 are a sequence showing opening of the envelope, gaining access to the selected item, replacing the selected item and resealing the envelope.
Figure 14:
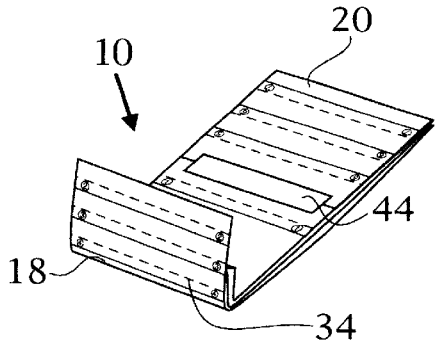
Figure 15:
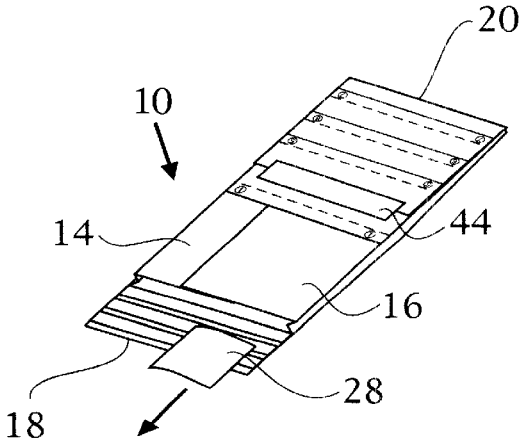
Figure 16:
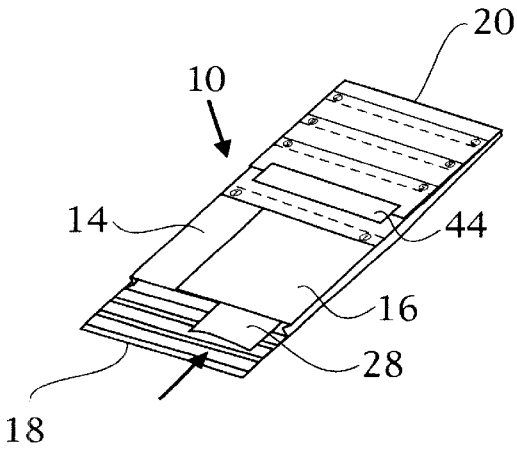
Figure 17:
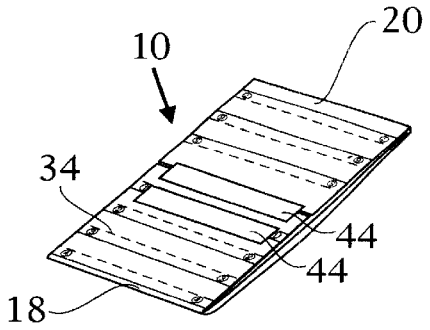

After the initial user is finished with the contents and has the material properly sealed as shown in FIGS. 13–17, the envelope can be transported to another office or investigator. If the second investigator needs to examine the selected item 28, he/she will sever the spacer 36 between position #1 and #2 marked on the first end panel 24 that was sealed and secured by the first entrant. After the second person is finished examining the selected items 28, he/she will perform the same task as person #1. He/she will remove the removable release protective strip 32 from the next adjacent segment (No. 2) and will reseal the first end panel 24 by abutting the second segment to the first segment that was adhered and security sealed by the first user. The second user will enter the required information on the second entry indicator 34 and will place security tape 44 over the second entry indicator and the seam between segments 1 and 2. In this manner, each entry indicator with information about the entrant is permanently affixed to the envelope.

The same procedure will be repeated for all other access into the envelope up to the last entry indicator 34 on the first end panel 26. (This would be segment No. 4 as shown on the figures but could be a greater or lesser number depending upon the size of the envelope and/or the amount of information desired on the entry indicator. If more information is desired, each entry indicator would be larger in area resulting in fewer segments.) In one embodiment, the envelope would be used to capacity.

Figure 18:
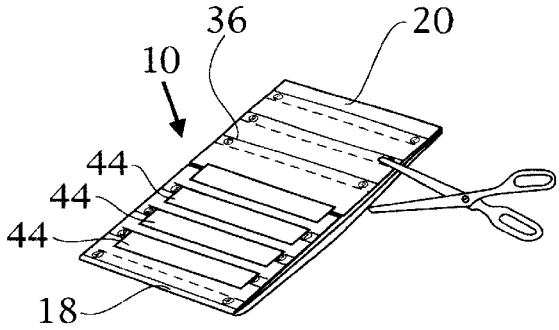
FIG. 18 is a perspective view showing another embodiment in which all of the segments on the at least one end panel are sealed with security tape and a spacer on the other end panel is being opened.
Figure 19:
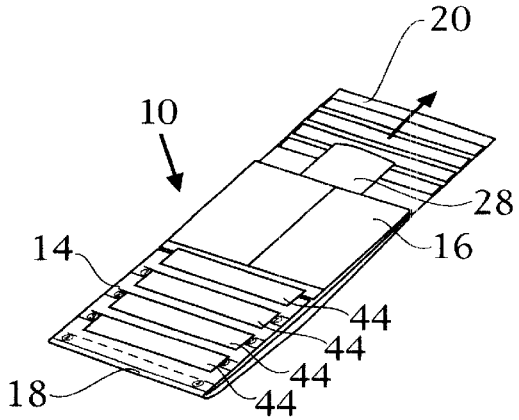
FIG. 19 is perspective view showing the other end panel unfolded and the selected item being removed.
Figure 20:
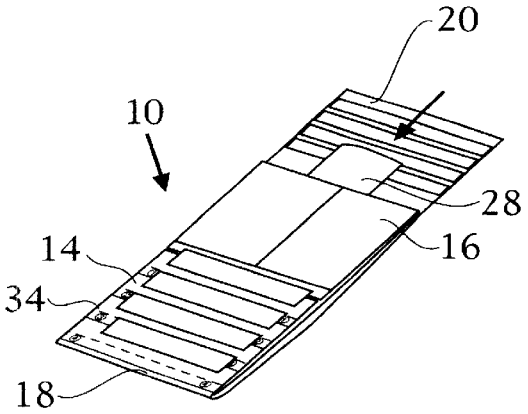
FIG. 20 is a perspective view showing the selected item being replaced adjacent to the other end panel.
Figure 21:
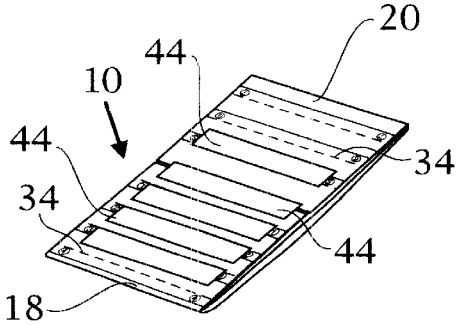
FIG. 21 is a perspective view showing the other end panel secured with security tape.

In an alternate embodiment, as shown in FIGS. 18–21, the second end panel 16 is also formed with uncoverable adhesive strips 30 and entry indicators 34. These would be identified as segments 5, 6 and 7 in an envelope of the size shown in the figures but, as noted above, is not limited to this number. Access Nos. 5, 6 and 7 will be made and sealed in the same manner except entry No. 5 is made by severing the spacer 36 adjacent to the permanent securing means 38 on the second end panel 20. This will enable the fifth user to gain access into the envelope from the opposite end of the envelope. That is the reason for opening on either end. Users 5, 6 and 7 will sever, seal and add security tape in the same manner as the previous four people. All entrants will be required to enter the information specified on the entry indicator 34. Thus, in a predetermined sequence, the present invention assures controlled access to the secured item.

As noted above, the envelope 10 may vary in size. A preferred size for the folded envelope is 12½ inches in length and 9½ inches in width. This size can comfortably contain documents of 8½×11 inch dimensions and also can accommodate seven entry indicators to provide adequate information on the entrants. It is preferred that the envelope be formed from a sturdy material to retain the selected item and to resist tearing of the envelope. It has been found that a product known as "Herculink" is satisfactory. The product includes fibrous nylon to resist tearing and/or bursting. One side is coated to be waterproof and moisture resistant.

Thus, the present invention fulfills a longstanding need for controlling access to selected item(s) and providing a permanent record of those persons who had had access to the selected item(s).

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. An envelope comprising:

a base panel having two opposing foldable side panels and two opposing foldable end panels, the end panels being approximately perpendicular to the side panels, the side panels being folded to partially overlap one another and being fixedly attached together thereby forming a pouch between the base panel and the overlapping side panels, the pouch being accessible adjacent to each end panel, wherein a selected item may be received in said pouch, at least one of the end panels having a plurality of spaced-apart uncoverable adhesive strips disposed on an underside of the at least one of the end panels defining a like plurality of spaced-apart entry indicators on an opposite upper side of the at least one of the end panels opposite from each adhesive strip, forming a plurality of spacers therebetween, a permanent securing means formed on the other end panel distal from the base panel, the end panels being folded toward one another over the overlapping side panels, the other end panel being permanently secured to the overlapping side panels, the at least one of the end panels being adhered to the overlapping side panels by the uncoverable adhesive strip, an entry being made on the entry indicator by a first person having access to the selected item, a security tape being disposed over the entry indicator preventing alteration thereof and securing the at least one of the end panels to the overlapping side panels, whereby the next adjacent spacer is sequentially opened by a person to gain access to the selected item, the identity of the person being entered on the next adjacent entry indicator, the selected item being replaced in the pouch, the next adjacent entry indicator being adhered to the overlapping side panels by the uncoverable adhesive strip and the security tape being disposed over the entry indicator and the at least one of the end panels such that a permanent record is maintained of persons having access to the selected item and unauthorized access is prevented.

2. The envelope of claim 1, further comprising at least one gusset being formed on each side panel such that the pouch formed between the base panel and the overlapping sides is expandable to receive selected items of varying size.

3. The envelope of claim 1, wherein a segment of each overlapping side panel adjacent to each end panel is folded when the end panels are folded thereby forming a security fold under each folded end panel which prevents unauthorized external access to the pouch between the base panel and the overlapping sides.

4. The envelope of claim 1, wherein the spaced-apart uncoverable adhesive strips, opposing spaced-apart entry indicators and spacers are formed on both of the end panels, whereby, after all the spacers have been opened and all the entry indicators have identification entered on the at least one of the end panels and the at least one of the end panels has been sealed with the security tape, the spacers on the other end panel are opened in sequence, thereby providing access to the selected item through the opposite end panel of the envelope.

5. The envelope of claim 4, wherein the entry indicators are indexed in a predetermined sequence such that the order of access to the selected item is recorded in a sequential order.

6. The envelope of claim 1, wherein the entry indicators provide for entry of at least a name, a location, a time, and a date.

7. The envelope of claim 1, wherein the permanent securing means on the other end panel is a permanent adhesive.

8. The envelope of claim 1, wherein the uncoverable adhesive strip is an adhesive coating on the underside of the end panel and a release protective strip over the adhesive coating, whereby the release protective strip is easily removed such that the adhesive coating may adhere the entry indicator to the overlapping side panels.

9. A method for securely transmitting a selected item in an envelope maintaining a record of all persons having access to the selected item, comprising the steps of:

forming an envelope having a base panel, two opposing foldable side panels and two opposing foldable end panels being connected to the base panel, at least one of the end panels having a plurality of spaced-apart uncoverable adhesive strips disposed on an underside thereof defining a like plurality of spaced-apart entry indicators on an opposite upper side, thereby forming a plurality of segments and a plurality of spacers therebetween, the other end panel having a permanent securing means thereon distal from the base panel, folding the side panels to partially overlap one another, fixedly attaching the overlapping side panels together thereby forming a pouch between the base panel and the overlapping side panels, the pouch being accessible adjacent to each end panel, disposing a selected item into the pouch between the base panel and the overlapping side panels, folding the end panels at a respective fold line toward one another over the overlapping side panels, permanently securing the other end panel to the overlapping side panels, uncovering the adhesive strip on one of the segments and adhering one of the segments of the at least one of the end panels to the overlapping side panels adjacent to the permanently secured other end panel, entering identification information on the entry indicator of the adhered segment of the at least one of the end panels, placing a security tape over at least a portion of the adhered segment to indicate tampering, in a predetermined sequence, severing a next adjacent spacer to gain access to the selected item in the envelope, repeating the adhering of the next adjacent segment, the entering of the identification information and the placing of the security tape, thereby assuring controlled access to the selected item and permanent recording of each access to the selected item.

10. The method of claim 9, further comprising the step of folding a respective part of the overlapping side panels with each end panel thereby forming a security fold under each folded end panel, said security folds preventing unauthorized external access to the selected item in the pouch between the base panel and the overlapping side panels.

11. The method of claim 9, further comprising forming spaced-apart uncoverable adhesive strips and spaced-apart entry indicators on both end panels wherein, after all the spacers in the at least one of the end panels have been severed, all entry indicators have had identification entered thereon and the one end panel has been resealed, the spacers on the other end panel are severed in sequence and the steps repeated, providing access to the selected item through the opposite end panel of the envelope.

12. The method of claim 9, further comprising forming at least one gusset on each side panel such that the pouch formed between the base panel and the overlapping sides is expandable to receive selected items of varying sizes.

* * * * *